US005385343A

United States Patent [19]

Davis, Sr.

[11] Patent Number: 5,385,343

[45] Date of Patent: Jan. 31, 1995

[54] BATTING TRAINER SYSTEM

[76] Inventor: John M. Davis, Sr., 17015 Hillswind Cir., Spring, Tex. 77379

[21] Appl. No.: 153,683

[22] Filed: Nov. 17, 1993

[51] Int. Cl.[6] ..... A63B 69/00

[52] U.S. Cl. ..... 273/26 R; 273/26 B; 273/26 C

[58] Field of Search ..... 273/26 R, 26 B, 26 C

[56] References Cited

U.S. PATENT DOCUMENTS 3,342,487 9/1967 David ..... 273/26 R 3,368,541 2/1968 Brink ..... 273/26 R X

*Primary Examiner*—William H. Grieb

*Attorney, Agent, or Firm*—Guy McClung

[57] ABSTRACT

Methods and apparatuses for training a batter are disclosed which include a system with a stance trainer and a trainer bat. In one aspect the stance trainer has an elevation member for elevating a lead foot of the batter and a location apparatus for locating a trailing foot of the apparatus. Repetition of a particular stance is achieved by re-emplacing the lead foot back on the elevation member in the same location after a swing and by re-positioning the trailing foot with respect to the location apparatus. A stop member or members and/or position indicator(s) can be used on top of the elevation member for locating and positioning the lead foot on the elevation member. The training bat, in one aspect, has at least one flat batting surface and, in one embodiment, two opposed flat batting surfaces with minimal space between them so that the ball is either hit well with a correctly oriented flat surface or is hit relatively poorly with an improperly oriented flat surface or with a narrow lateral surface disposed between the two flat surfaces. In one aspect, a training bat is disclosed with a net mounted to a frame and a handle extending from the frame, the net for catching a ball when the bat is properly oriented. A ridge on a handle of the bat can indicate to the batter the disposition of the flat surfaces with respect to the batter's hands, fingers, and wrists. An eyesight restriction device restricts a batter's peripheral and/or front view vision to help a batter maintain eye contact with an incoming ball until it is contacted by a bat.

12 Claims, 3 Drawing Sheets

FIG. 1
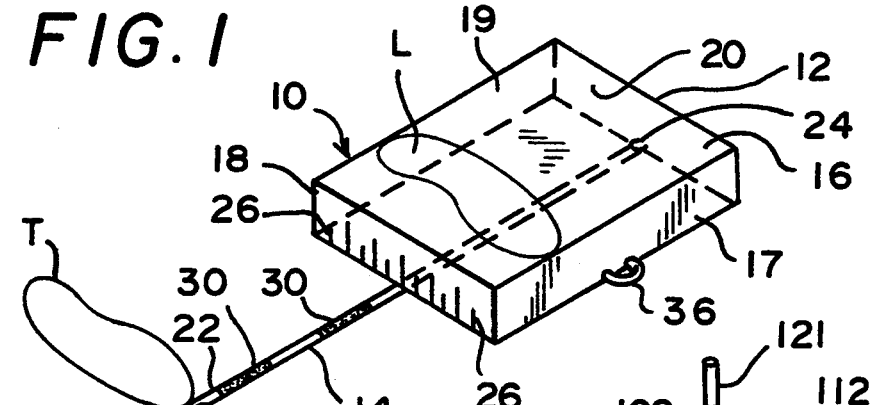
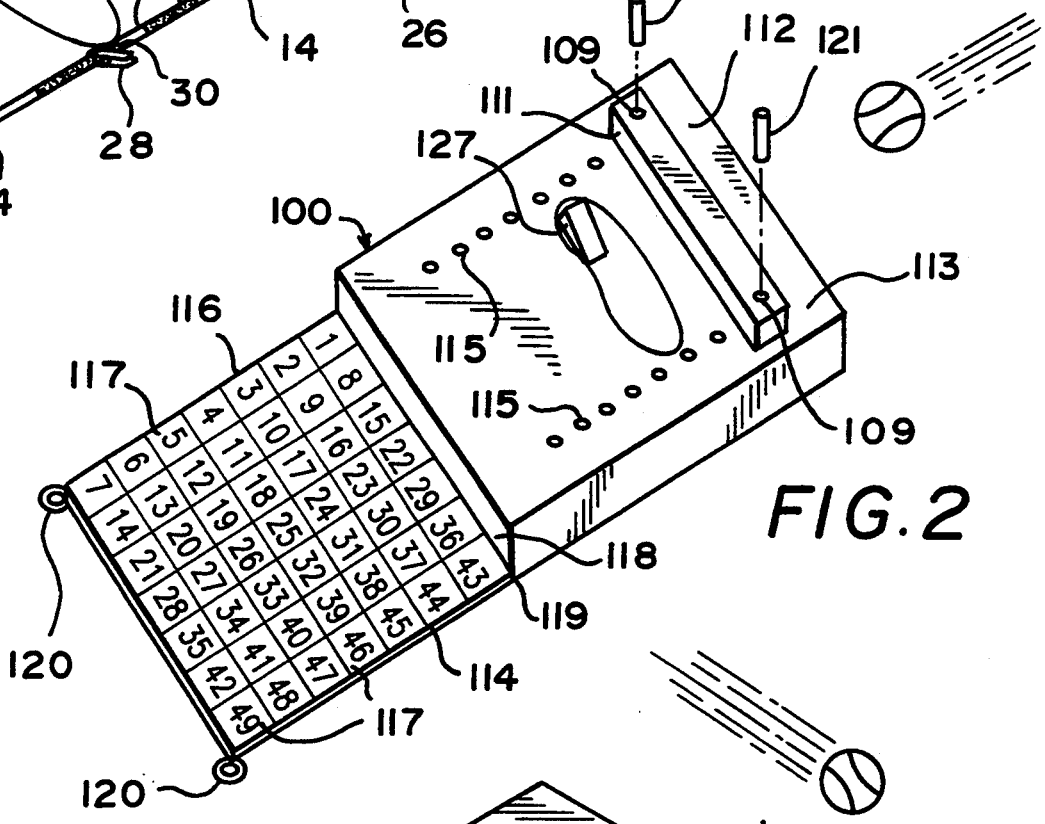
FIG. 2
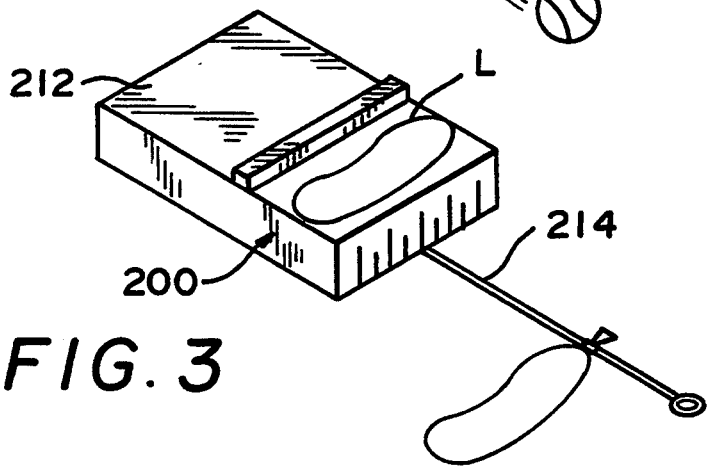
FIG. 3

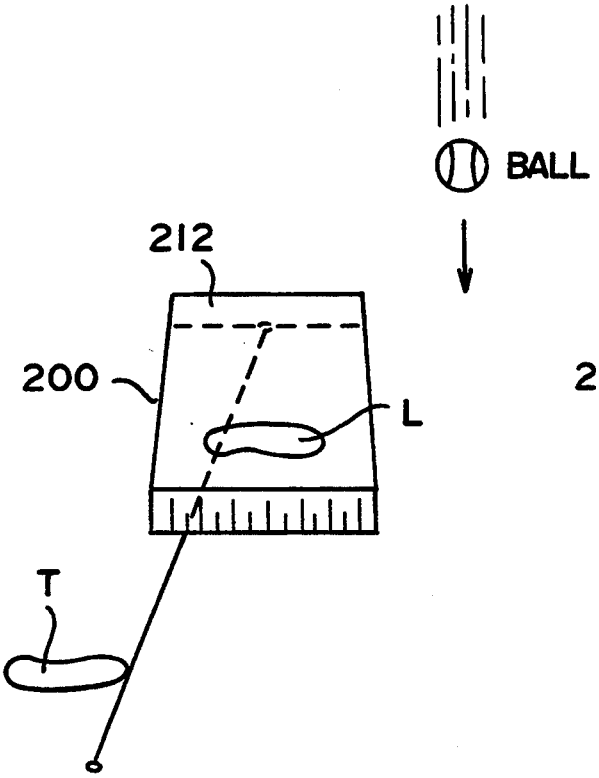
FIG. 4
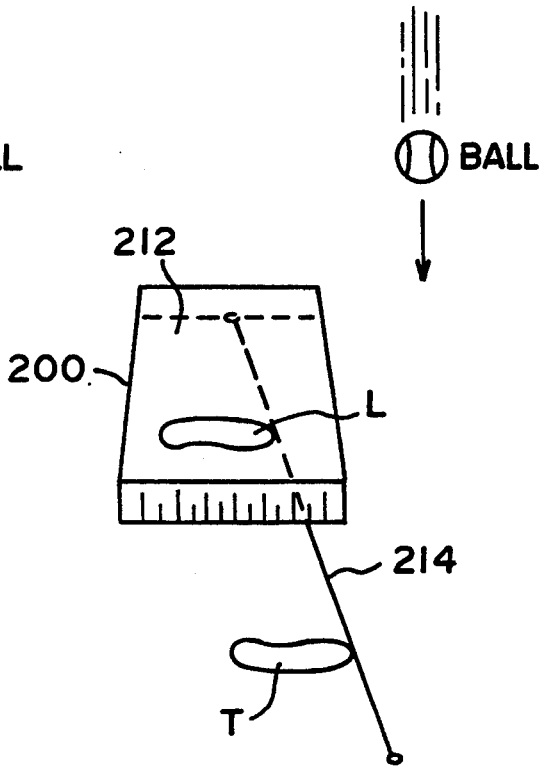
FIG. 5
FIG. 6
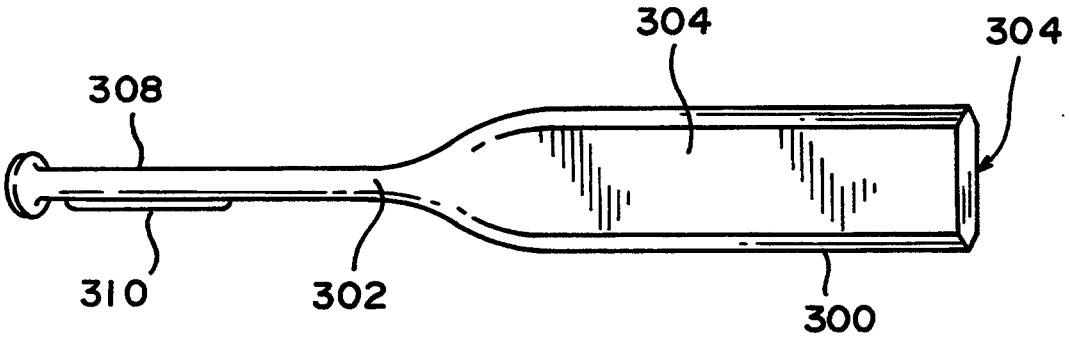

BATTING TRAINER SYSTEM

BACKGROUND OF THE INVENTION

1. Field of the Invention

This invention is directed to batting training apparatuses; in one aspect, to a trainer that assists in improving a batter's stance and movement while batting; in one aspect to a device that helps a batter keep eyes on a ball; a training bat; and in one aspect to a system with such a trainer, with such a device, and with such a training bat.

2. Description of Related Art

The prior art includes a variety of devices for teaching batting techniques and stances. Examples of such devices are shown in these U.S. Pat. Nos. 3,350,096; 3,466,040; 3,940,131; 3,979,116; 4,194,735; 4,225,133; 4,258,916; 4,516,772; 4,757,995; 4,932,656; 5,037,094; and 5,082,262.

There has long been a need for a device useful in training a batter to assume a variety of desired stances while batting. There has long been a need for a device useful in training a batter not to lunge forward while batting. There has long been a need for a device useful in training a batter to properly place his or her feet with respect to a pitcher and with respect to home plate while batting. There has long been a need for a device which helps a batter keep eyes on the ball. There has long been a need for a system which is useful for training a batter to maximize the power with which the ball is hit and to correctly manipulate hands and wrists while batting.

SUMMARY OF THE PRESENT INVENTION

Effective batting involves a batter's weight, wrists, and watching a ball. The present invention discloses, in one aspect, a batting trainer for effective weight distribution and control which has an elevation member for elevating one foot, a lead foot, of a batter and locating apparatus for positioning the batter's other foot, a trailing foot, with respect to the elevation member. By thus appropriately locating both feet of the batter, two things are accomplished: 1. The stance of the batter is adjusted and set with respect to the home plate and with respect to the pitcher; and 2. Elevation of the batter's lead foot inhibits or prevents the batter from lunging forward as the bat is swung at the ball.

By changing her or his stance, a batter can adjust the "target" that the batter's body presents to a pitcher. In a "closed" stance in which with respect to a line from the batter to the pitcher the batter's feet are relatively lined up with the line, the batter's body is necessarily turned sideways to the pitcher and the pitcher can view a limited amount of the batter's torso, arms, legs, etc. In an "open" stance in which the batter's feet are spread out from each other with respect to the batter-pitcher line, the pitcher has more of a frontal view of the batter and can see more of the batter's body than is viewed when the batter is in a closed stance. The locating apparatus of this invention's batting trainer provides a way for a batter to place her or his feet at known points prior to swinging the bat and, after each swing, to repeat the exact position thereby leaning that particular stance.

Many batters, in anticipation of swinging the bat at an incoming ball, move or lunge forward toward the pitcher and toward the ball. This lunging can decrease the power with which the batter hits the ball by preventing the batter from using his or her weight effectively to get "behind" the ball. This lunging can also result in an off-balance swing which is not as powerful as it would be otherwise.

In one embodiment of a batting trainer according to this invention, the elevation member includes a box of desired height, preferably with a top stop member on a top thereof against which a batter places his or her lead foot for correct location of the lead foot and for inhibiting lunging at the ball. In one aspect a cord of known length is connected to the elevation member and extends from it for locating the batter's trailing foot. The end of the cord or a marker along its length may be used as a location point for the other foot. For example, the cord is stretched from the elevation member along the ground adjacent thereto and the batter places a part of the trailing foot, e.g. the toe, at the end point of the cord. After swinging, the cord is again stretched from the elevation member to precisely relocate the trailing foot. Appropriate location of the point of connection of the cord to the elevation member and visual indices on the elevation member may be used to insure a correct angle between the trailing foot and the elevation member. In another aspect a flat member with a variety of points located thereon or with a grid thereon may be used for correct and repetitive location of the trailing foot. Similarly marks or a grid can be provided on top of the elevation member for correct and repetitive location of the lead foot thereon, with or without use of the stop member.

Both the elevation member and the locating apparatus may be removably secured to the ground by appropriate stakes or spikes so that the batting trainer is maintained in one position for training of each batter. For further inhibition of anticipatory lunging, an inclined portion may be provided on top of the elevation member.

To further assist in batting training a bat is provided according to this invention with one or with dual opposed flat surfaces for hitting the ball. Incorrect twisting or "rolling" of such a bat during swinging, upon striking the ball, results in an ineffective and/or erratic hit as compared to correct wrist roll (which results in proper bat-to-ball contact and most effective application of batter force to the ball).

A batter who watches a ball all the way to the point at which the ball contacts the bat is much more effective at hitting the ball and at hitting it with maximum force. To train a batter to watch the ball until it is hit, this invention provides a vision restriction device which compels a batter to turn his or her head in order to maintain eye contact with a ball.

It is, therefore, an object of at least certain preferred embodiments of the present invention to provide:

New, useful, unique, efficient, and safe devices and methods for effective batting training;

Such devices and methods for training a batter to assume a variety of distinct batting stances;

Such methods and devices for training a batter not to lunge forward at an incoming ball;

Such methods and devices for training a batter to hit a ball with a maximum of hitting power;

Devices and methods for training a batter to correctly orient the bat with respect to an incoming ball and to roll wrists to correctly hit the ball; and Visual devices to aid a batter in maintaining eye contact with a ball.

This invention resides not in any particular individual feature, but in the combinations of them herein disclosed and claimed and it is distinguished from the prior art in these combinations with their structures and functions.

There has thus been outlined, rather broadly, features of the invention in order that the detailed descriptions thereof that follow may be better understood, and in order that the present contributions to the arts may be better appreciated. There are, of course, additional features of the invention that will be described hereinafter and which may form the subject matter of the claims appended hereto. Those skilled in the art will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar that do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 1 is a top view of a trainer according to the present invention.

FIG. 2 is a perspective view of a trainer according to this invention.

FIGS. 3, 4, and 5 are schematic views of a trainer according to the present invention.

FIG. 6 is a side view of a training bat according to the present invention.

DESCRIPTION OF EMBODIMENTS PREFERRED AT THE TIME OF FILING FOR THIS PATENT

Figure 7:
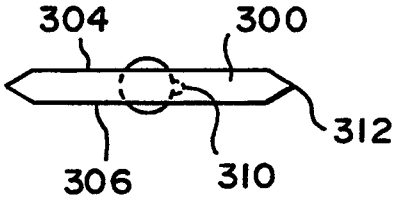
FIG. 7 is an end view of the bat of FIG. 6 in cross-section.

Referring now to FIG. 1, a batting trainer 10 according to the present invention has an elevation member 12 for elevating a batter's lead foot L and a locating apparatus 14 for locating a batter's trailing foot T with respect to the lead foot L. The elevation member 12 has a top 16 connected to sides 17, 18, 19, and 20. The locating apparatus 14 has a movable cord 22 connected at a point 24 to the side 20 which is distal from the trailing foot T.

The cord 22 is movable in an arc about the point 24. A position of the cord 22 with respect to one or more indicia marks 26 on the side 18 of the elevation member 12 indicates an angle of the cord and hence of a trailing foot position with respect to the elevation member 12 and hence with respect to the lead foot L. Position of the trailing foot L along the cord 22 can be indicated by any appropriate means including but not limited to a removable marker device such as a clip 28 and/or with colored segments 30 along the cord 22. A spike or stake 32 can hold the cord 22 in place on the ground G or can be disposed through a ring 34 attached to the cord 22. Similarly the elevation member 12 may be removably secured on the ground with one or more rings 36 and corresponding spikes.

In an embodiment 100 of a batting trainer according to the present invention as shown in FIG. 2, an elevation member 112 (like the elevation member 12, FIG. 1) has at least one foot stop member 111 removably secured on a top 113 of the elevation member 112. This stop member 111 provides an abutment against which a batter places a lead foot for stability and for correct foot location. The stop member also facilitates repetition of a previous stance after a swing has been completed. Two such stop members may be employed with a batter's foot placed between them. Removable securement of the stop member to the elevation member may be achieved in any appropriate manner, including but not limited to pairs of corresponding holes, holes 109 in the stop member and holes 115 in the elevation member, and pegs 121 which are insertable into and through the holes. A location apparatus 114 shown in FIG. 2 has a sheet member 116 with a grid thereon. The grid can be of numbers, lines, letters, symbols, color areas, or any other suitable indicia. As shown the grid has a plurality of numbered boxes 117.

As shown the sheet member 116 is secured to a side 118 of the elevation member 112 along a line 119 and is securable on the ground by driving stakes (not shown) through the rings 120 which are secured to the sheet number 116. It is within the scope of this invention for the sheet member to be initially separate from and unconnected to the elevation member 112 and to emplace it on the ground adjacent the elevation member 112. Multiple rings about the sheet member's periphery may be used to facilitate securing the sheet member on the ground.

An inclined portion 127 on the top 113 of the elevation member 112 can be used to further elevate a batter's lead foot to further inhibit anticipatory lunging forward.

FIGS. 3, 4, and 5 illustrate schematically a variety of batter stances which may be assumed by a batter facing a ball thrown at the batter. By using a batter trainer 200 shown schematically in FIGS. 3, 4, and 5, which has an elevation member 212 and a locating apparatus 214 a batter can initially correctly position a lead foot L and a trailing foot T prior to swinging at the ball and can then, after completing the swing and moving the feet, re-position the feet in substantially the identical position on which they were prior to the swing. Thus a batter can develop and remember a particular stance and can learn to adjust stance for maximum results.

FIG. 3 shows a typical straightaway stance. FIG. 4 shows a typical closed stance. FIG. 5 shows a typical open stance.

FIGS. 6 and 7 illustrate a training bat 300 according to the present invention which has a body member 302; batting surfaces 304 and 306; a handle 308; and a ridge member 310. The batting surfaces are preferably parallel to each other and spaced apart, preferably no more than by a half inch so that lateral surfaces 312 between the batting surfaces 304 are substantially small. Thus the lateral surfaces 312 are too small to constitute an effective surface for hitting a ball.

The training bat 300 has at least one, and preferably two, substantially flat batting surfaces 304 which are most preferably parallel. Preferably the bat has a weight similar to a typical conventional bat and the ridge member 310 is aligned with the one or both of the flat batting surfaces 304 so that a batter grasping the handle 308 feels the ridge member 310 with his fingers, the ridge member 310 indicating by touch the orientation of the flat batting surface(s) with respect to the batter's hands and wrists. This facilitates correct batter wrist roll during a swing so that the batter moves wrists to bring a flat batting surface around in correct orientation with respect to an incoming ball to apply maximum batting power to the ball and to use wrist action to propel the bat at the ball.

If a ball is not hit directly with a flat surface of the training bat it will either be hit upwardly at a relatively high angle or downwardly at a relatively low angle. This angle will be evident to the batter and to a batting coach and will indicate incorrect wrist roll during a swing of the bat. Without correct wrist roll, a batter will not easily hit the ball with the narrow lateral surface between the flat surfaces. With a late wrist roll the ball would be hit upwardly. With an early wrist roll the ball would be hit downwardly. With correct wrist roll the ball is hit head on with a flat surface of the bat.

Figure 8:
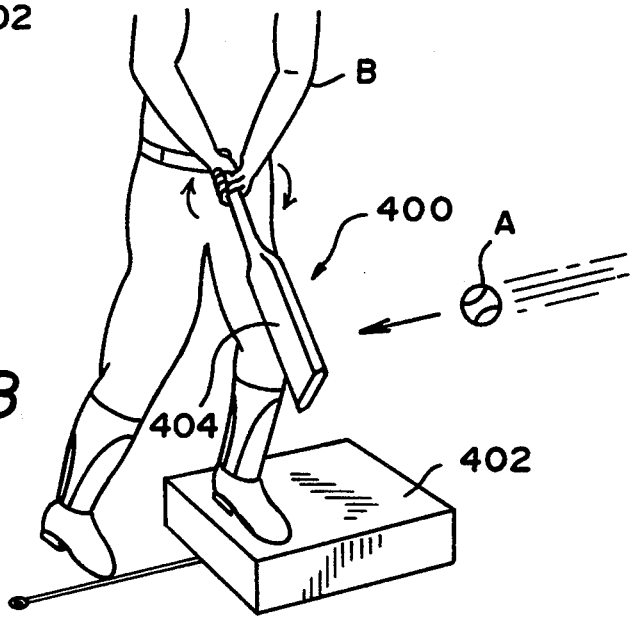
FIG. 8 is a schematic view of a training system according to the present invention.

As shown schematically in FIG. 8 a batting training system 400 has a batting trainer 402 (like the trainer 10) and a training bat 404 (like the bat 300). As shown the trainer 402 facilitates correct assumption of a stance by a batter B and inhibits anticipatory lunging. Use of the training bat 404 facilitates correct bat movement and wrist roll to achieve a maximum application of batting force to an incoming ball A.

Figure 9:
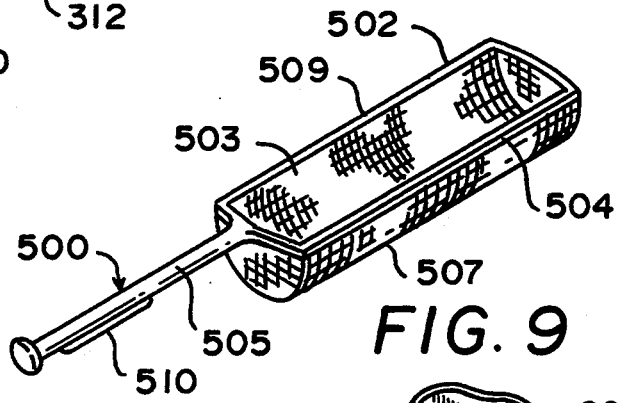
FIG. 9 is a perspective view of a bat device according to the present invention.

FIG. 9 illustrates a bat 500 similar to the bat 300 (FIG. 6) but with a frame 502 rather than a solid body member 302. The frame 502 includes sides 504 and 509. The frame 502 defines an opening 503 and a net 507 is connected to the frame 502 to catch a ball passing through the opening 503. The frame 502 is connected to a handle 505 with a ridge 510 (like the ridge 310, FIG. 6). Proper bat orientation often results in a ball passing through the frame opening 503 and being caught in the net 507. Preferably, a hollow ball such as a "Whiffle" ball is used and the opening 503 is between about three and about four inches wide.

Figure 10:
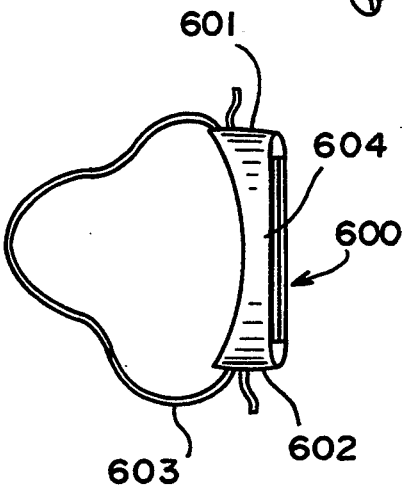
FIG. 10 is a top view of a visual aid device for batting training according to the present invention.
Figure 11:
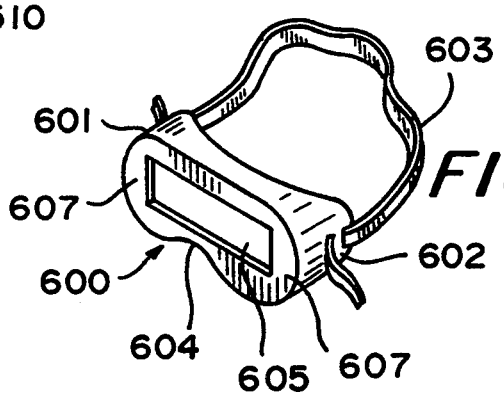
FIG. 11 is a front perspective view of the device of FIG. 10.

A visual restriction device 600 as shown in FIGS. 10 and 11 has an adjustable or expandable head strap 603 for adjustably emplacing the device 600 about a batter's head. A body member 602 has opaque sides 601 and an opaque front plate 607 with an opening 605 therethrough. When the device 600 is in place on a batter's head with a bridge portion 604 of the body member 602 on a batter's nose, the batter looks through the opening 605 to see an incoming ball. Due to the opaque sides 601 and the opaque front plate 607, the batter is compelled to turn her or his head in order to follow the ball and maintain eye contact with it until the bat contacts the ball. In one embodiment only the sides 601 are opaque to block peripheral vision.

As desired, in certain embodiments a lens or lenses (prescription or clear) may be secured in the opening 605. By making the opening 605 smaller, vision may be more restricted; by making the opening larger, vision to the front is less restricted.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A batting trainer for training a batter the batter having two feet including a first lead foot and a second trailing foot, the trainer comprising an elevation member for removable emplacement thereon of the batter's lead foot, the elevation member elevating the batter's lead foot above ground on which the trainer is placed, the elevation member removably securable to the ground, location apparatus for locating the batter's trailing foot on the ground with respect to the elevation member, the elevation member removably securable to the ground, the location apparatus including a movable member removably securable to the ground, and stop member means secured to a top of the elevation member for abutting the batter's lead foot, the stop member means removably securable to the elevation member.

2. The trainer of claim 1 wherein the stop member means is adjustably securable at a plurality of different positions on top of the elevation member.

3. The trainer of claim 1 wherein the stop member means comprises at least one bar extending across the elevation member.

4. The trainer of claim 1 comprising also the location apparatus comprising a cord movably attached to the elevation member and at least partially extending therefrom.

5. The trainer of claim 4 wherein the cord is attached at a distal side of the elevation member and extends past a near side of the elevation member, said elevation member having a plurality of marks thereon, so that an angle of the cord with respect to the near side of the elevation member corresponds to disposition of the cord with respect to one of the plurality of marks.

6. The trainer of claim 5 comprising also a marker device removably securable on the cord for indication of a foot location at a point at which the marker device is secured on the cord.

7. The trainer of claim 1 comprising also the location apparatus comprising a grid member emplaceable on the ground adjacent the elevation member, the grid member having a plurality of marks thereon for indicating location of a trailing foot.

8. The trainer of claim 1 comprising also an inclined member on a top of the elevation member for emplacement thereon of the batter's lead foot.

9. A batting trainer for training a batter to swing a bat, the batter having two feet including a first lead foot and a second trailing foot, the trainer comprising an elevation member for removable emplacement thereon of the batter's lead foot, the elevation member elevating the batter's lead foot above ground on which the trainer is placed and elevating the lead foot as the bat is swung to inhibit forward lunging by the batter, the second trailing foot on the ground as the bat is swung, securement means for securing the elevation member to the ground to maintain it in one position during batting as the bat is swung, and location apparatus for locating the batter's trailing foot on the ground with respect to the elevation member.

10. The trainer of claim 9 including also the location apparatus including a movable member removably securable to the ground.

11. The trainer of claim 10 comprising also the location apparatus comprising a cord movably attached to the elevation member and at least partially extending therefrom, and an inclined member on a top of the elevation member for emplacement thereon of the batter's lead foot.

12. A batting trainer for training a batter, the batter having two feet including a first lead foot and a second trailing foot, the trainer comprising an elevation member for removable emplacement thereon of the batter's lead foot, the elevation member elevating the batter's lead foot above ground on which the trainer is placed, location apparatus for locating the batter's trailing foot on the ground with respect to the elevation member, the location apparatus comprising a cord movably attached to the elevation apparatus and at least partially extending therefrom, stop member means secured to a top of the elevation member for abutting the batter's lead foot, the stop member means adjustably securable at a plurality of different positions on top of the elevation member, the cord attached at a distal side of the elevation member and extending past a near side of the elevation member having a plurality of marks thereon, so that an angle of the cord with respect to the near side of the elevation member corresponds to disposition of the cord with respect to one of the plurality of marks.

* * * * *